US008149175B2

(12) United States Patent
Ryou et al.

(10) Patent No.: US 8,149,175 B2
(45) Date of Patent: Apr. 3, 2012

(54) MULTIPLE BAND ANTENNA

(75) Inventors: Byung Hoon Ryou, Seoul (KR); Won Mo Sung, Siheung-si (KR); Gi Ho Kim, Anyang-si (KR)

(73) Assignee: EMW Co., Ltd., Incheon (KR)

( * ) Notice: Subject to any disclaimer, the term of this patent is extended or adjusted under 35 U.S.C. 154(b) by 195 days.

(21) Appl. No.: 12/527,394

(22) PCT Filed: Feb. 1, 2008

(86) PCT No.: PCT/KR2008/000612

§ 371 (c)(1),
(2), (4) Date: Mar. 12, 2010

(87) PCT Pub. No.: WO2008/100028

PCT Pub. Date: Aug. 21, 2008

(65) Prior Publication Data

US 2010/0188302 A1 Jul. 29, 2010

(30) Foreign Application Priority Data

Feb. 14, 2007 (KR) ..... 10-2007-0015316

(51) Int. Cl.
*H01Q 1/00* (2006.01)

(52) U.S. Cl. ..... 343/722; 343/745; 343/749

(58) Field of Classification Search ..... 343/702, 343/722, 745, 749

See application file for complete search history.

(56) References Cited

U.S. PATENT DOCUMENTS 4,259,673 A 3/1981 Guretzky
5,767,812 A 6/1998 Basciano et al.
5,835,067 A * 11/1998 Goodman ..... 343/722
7,102,586 B2 * 9/2006 Liang et al. ..... 343/795
2005/0001769 A1 1/2005 Qi et al.
2005/0195124 A1 9/2005 Puente Baliarda et al.
2005/0225488 A1 10/2005 Nakagawa et al.

(Continued)

FOREIGN PATENT DOCUMENTS

JP 2003-142930 5/2003

(Continued)

OTHER PUBLICATIONS

PCT International Search Report for PCT Counterpart Application No. PCT/KR2008/000612 containing Communication relating to the Results of the Partial International Search Report, 2 pgs., (Apr. 16, 2008).

Extended European Search Report for EP Counterpart Patent Application No. 08712268.5-1248, 6 pgs. (Jan. 19, 2010).

Office Action for EP Counterpart Application No. 08712268.5-1248, 1 pg. (Apr. 16, 2010).

(Continued)

*Primary Examiner* — Tan Ho

(74) *Attorney, Agent, or Firm* — Blakely, Sokoloff, Taylor & Zafman LLP.

(57) ABSTRACT

The present invention provides a multiple band antenna, including a first radiation element adapted to resonate at a first resonant frequency band by employing a resonant length, which is reduced by a coupling effect with a neighboring radiation element, a power feed unit coupled to one lower side of the first radiation element, a first inductor coupled in series to the other lower side of the first radiation element, a second radiation element adapted to face the first radiator to thereby obtain the coupling effect, wherein the second radiation element has a predetermined lower portion coupled to the first inductor, a second inductor having one end coupled in series to a predetermined upper portion of the second radiation element, and a third radiation element coupled to the other end of the second inductor, wherein the third radiation element operates as one radiation element together with the second radiation element and resonates at a second frequency band.

9 Claims, 3 Drawing Sheets

U.S. PATENT DOCUMENTS

| | | | | |
|---|---|---|---|---|
| 2006/0022883 | A1 | 2/2006 | Vincent | |
| 2010/0141536 | A1 * | 6/2010 | Zhang et al. | 343/702 |

FOREIGN PATENT DOCUMENTS

| | | | |
|---|---|---|---|
| WO | WO 2005/001989 | A2 | 1/2005 |

OTHER PUBLICATIONS

Office Action for EP Counterpart Application No. 08712268.5-1248, 6 pgs. (Apr. 1, 2011).

* cited by examiner

[Fig. 1]
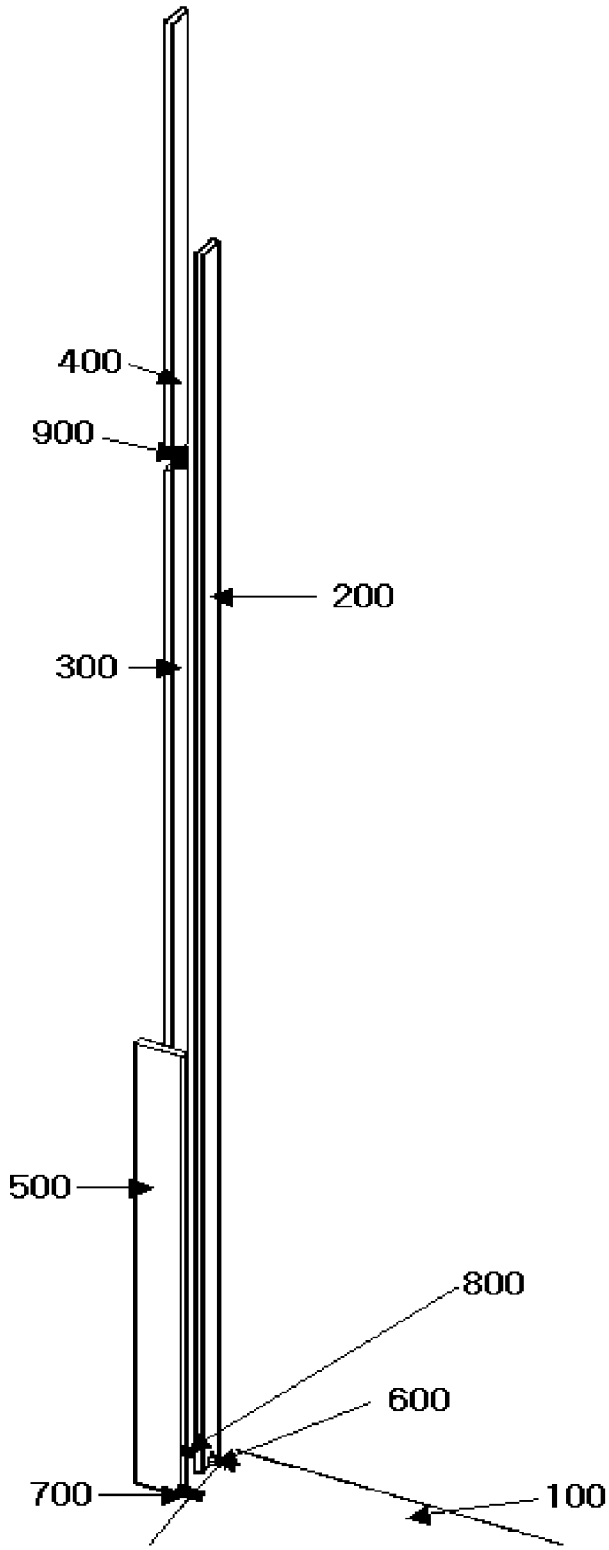

[Fig. 2]
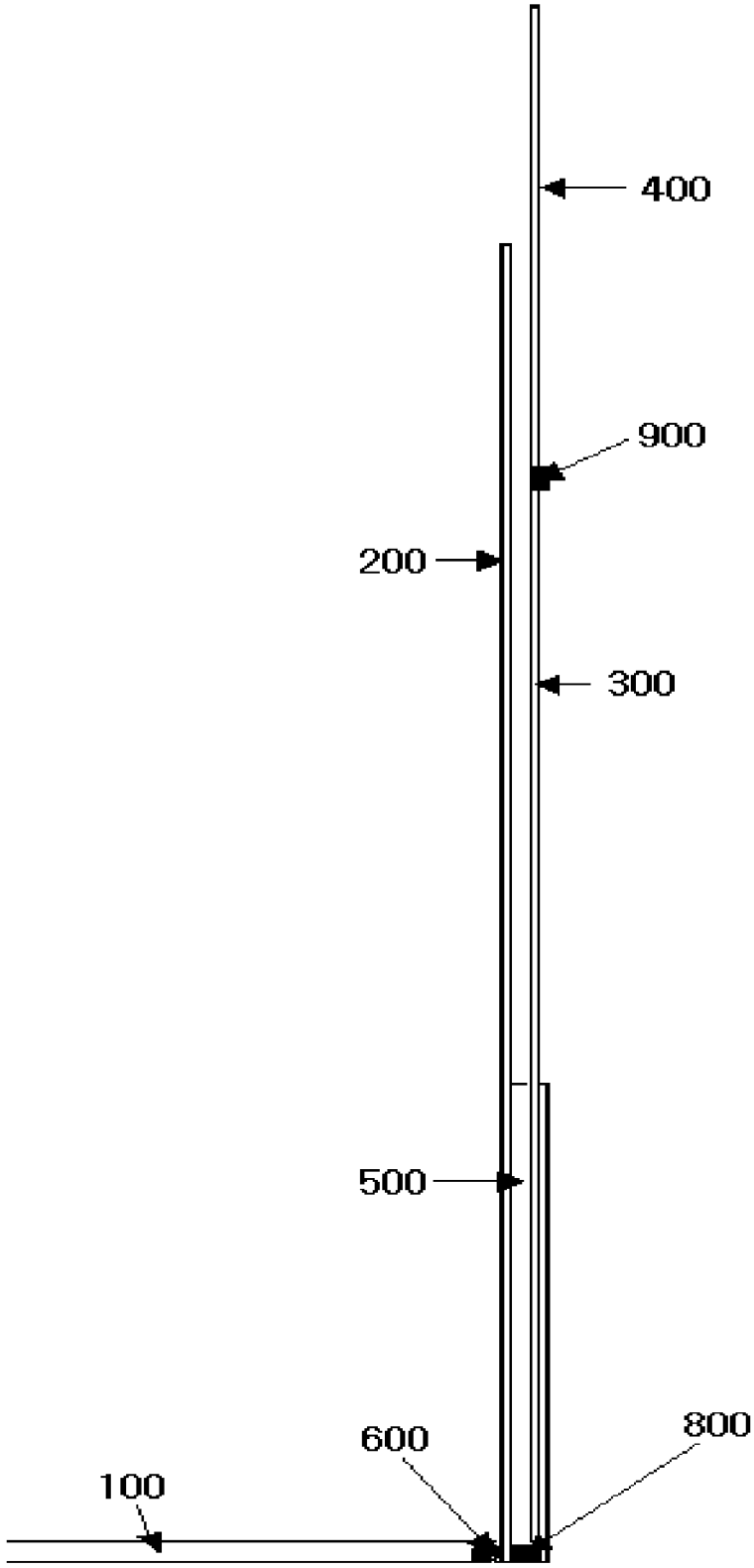

[Fig. 3]
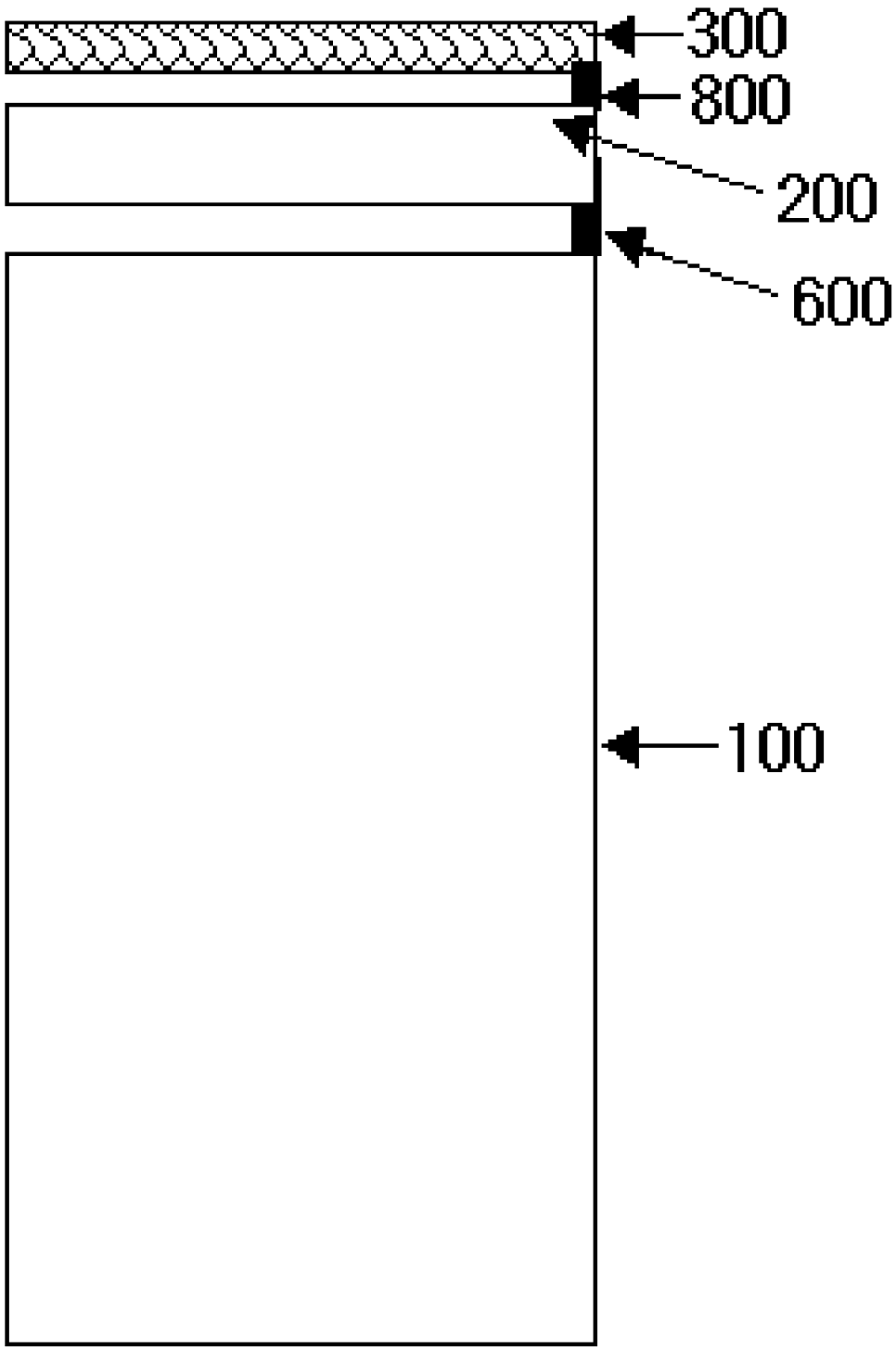

MULTIPLE BAND ANTENNA

CROSS-REFERENCE TO RELATED APPLICATIONS

This patent application is a U.S. National Phase application under 35 U.S.C. §371 of International Application No. PCT/KR2008/000612, filed on Feb. 1, 2008, entitled MULTIPLE BAND ANTENNA, which claims priority to Korean patent application number 10-2007-0015316, filed Feb. 14, 2007.

TECHNICAL FIELD

The present invention relates to a multiple band antenna, and more particularly, to a multiple band antenna in which resonance is generated at different frequencies using a plurality of radiation elements covering different radiation bands, thereby minimizing the length of the antenna and enabling communication using different frequency bands through a single antenna.

In particular, according to the present invention, a single antenna can be applied to different portable terminals. Thus, the use range and coverage of a corresponding antenna can be expanded to thereby improve the merchantability and compatibility of the antenna. Further, since different services can be used in one terminal, terminal functions can be diversified and merchantability of products can be improved.

BACKGROUND ART

With the development of communication technologies, in particular, wireless communication technologies along with the advancement of the electronic industry, a variety of portable terminals that enable voice and data communication anywhere, anytime and with anyone have been developed and generalized. Further, in order to improve the portability of portable terminals, various technologies for miniaturizing the portable terminals (for example, the development of high-density integrated circuit elements, a miniaturization method of an electronic circuit board, etc.) have been developed. As the purposes to use the portable terminals are diversified, terminals that perform various functions, such as a terminal for navigation or a terminal for Internet, have been developed.

Meanwhile, one of the important technologies in wireless communication technology is a technology pertinent to the antenna. Antennas using various methods, such as a coaxial antenna, a road antenna, a loop antenna, a beam antenna, and a super gain antenna, have now been known.

The antennas are for using a specific frequency band. If it is sought to employ various services using different frequency bands, such as voice, data communication and Internet, through portable terminals, a user felt inconvenient with the use of different portable terminals per on a service basis.

To solve this inconvenience, there is a need for the development of a technology where different frequency bands can be used using a single antenna.

In particular, in order to obtain the broadband radiation characteristic, the size (length, etc.) of the antenna must be increased. Such an increase in the size of the antenna becomes an obstacle to not only the miniaturization of the antenna, but also the miniaturization of a portable terminal on which a corresponding antenna is mounted.

Accordingly, there is a need to develop an antenna that can be miniaturized with the broadband characteristic.

SUMMARY

Accordingly, the present invention has been made to overcome the above-mentioned problems occurring in the prior art, and it is an object of the present invention to provide a multiple band antenna in which resonance is generated at different frequencies using a plurality of radiation elements covering different radiation bands, thereby minimizing the length of the antenna and enabling communication using different frequency bands through a single antenna.

Further, an object of the present invention to provide a multiple band antenna that can be used in different services, thus improving diversification of the terminal functions and merchantability of products.

To accomplish the above objects, the present invention provides a multiple band antenna, including a first radiation element adapted to resonate at a first resonant frequency band by employing a resonant length, which is reduced by a coupling effect with a neighboring radiation element; a power feed unit coupled to one lower side of the first radiation element so as to supply power to the first radiation element; a first inductor coupled in series to the other lower side of the first radiation element; a second radiation element adapted to face the first radiator to thereby obtain the coupling effect, wherein the second radiation element has a predetermined lower portion coupled to the first inductor; a second inductor having one end coupled in series to a predetermined upper portion of the second radiation element; and a third radiation element coupled to the other end of the second inductor, wherein the third radiation element operates as one radiation element together with the second radiation element and resonates at a second frequency band.

Preferably, the multiple band antenna further includes a ground stub having a band expansion effect, wherein a length of the ground stub can be turned in order to control a detailed frequency; and a ground stub matching unit matched to a resonant frequency through the control of the ground stub.

Here, the first inductor or the second inductor serve as an extension coil, thus reducing the size of the antenna.

Further, the first inductor operates as a low-pass filter, thus preventing the second radiation element from affecting characteristics of other bands other than the second resonant frequency band.

Further, the second inductor can have a cutoff characteristic with respect to resonant frequency bands other than the second resonant frequency band and has very low impedance at the second resonant frequency band, so the second radiation element and a third radiation element are connected to each other and together operate as one radiation element.

Further, the length of the second or third radiation element can be $\frac{1}{5}\lambda$ or less of the first resonant frequency and operate as a parasitic element of the first radiation element.

Further, the first radiation element can resonate at a DVB-H band, and the second radiation element and a third radiation element can resonate at a BANDIII band.

Further, the first radiation element can resonate at a third resonant frequency band, that is, a harmonic component of the first resonant frequency.

On the other hand, the present invention provides a wireless communication device including the multiple band antenna.

As described above, according to the present invention, the coupling effect can be accomplished and resonance can be generated at different frequencies by using a plurality of radiation elements covering different radiation bands. Accordingly, the length of the antenna can be minimized and communication can be performed using different frequency bands through a single antenna.

Further, a single antenna can be applied to different portable terminals. The use range and coverage of a corresponding antenna can be expanded and the merchantability and compatibility of the antenna can be improved.

Further, the present invention enables different services to be employed through one terminal. Accordingly, diversification of the terminal functions and merchantability of products can be improved.

BRIEF DESCRIPTION OF THE DRAWINGS

FIG. 1 is a perspective view showing a multiple band antenna according to an embodiment of the present invention;

FIG. 2 is a lateral view showing the multiple band antenna of FIG. 1; and FIG. 3 is a diagram showing a multiple band antenna according to another embodiment of the present invention.

DETAILED DESCRIPTION

Reference should be made to preferred embodiments of the present invention with reference to the accompanying drawings in order to fully understand the present invention, the advantages in terms of the operation of the present invention, and the objects accomplished by the implementation of the invention.

The present invention will now be described in detail in connection with preferred embodiments with reference to the accompanying drawings. The same reference numbers are used throughout the drawings to refer to the same parts.

FIG. 1 is a perspective view showing a multiple band antenna according to an embodiment of the present invention. FIG. 2 is a lateral view showing the multiple band antenna of FIG. 1.

Referring to FIGS. 1 and 2, the multiple band antenna of the present invention includes a terminal circuit board 100, a power feed unit 600 connected to a pre-determined portion of the terminal circuit board 100 and supplied with power from the terminal circuit board 100, first to third radiation elements 200, 300, 400 disconnected from the power feed unit 600 and adapted to radiate light at different frequency bands, a ground stub 500 connected to the terminal circuit board 100 and coupled to the plurality of radiation elements, and a ground matching unit 700 matched to the ground stub.

In more detail, the first to third radiation element 200, 300, and 400 can be configured in a monopole form. The first radiation element 200 and the second radiation element 300 can be connected through a first inductor 800. The second radiation element 300 and the third radiation element 400 can be connected through a second inductor 900. Meanwhile, the first to third radiation elements 200, 300, and 400 can be formed using metal sheets of various materials depending on those having ordinary skill in the art. Alternatively, the first to third radiation elements 200, 300, and 400 can be implemented on a PCB using a method such as plating or printing.

The first radiation element 200 can resonate at a first resonant frequency, for example, at the 500 MHz band used in the digital video broadcasting-handheld (DVB-H) frequency band. The first radiation element 200 is supplied with power from the power feed unit 600 and can have a band expansion effect because of the second radiation element 300 operating as a coupling element in the DVB-H frequency band. Further, the first radiation element 200 can cover a very wide DVB-H bandwidth since it can have a secondary band expansion effect through the length of the ground stub 500.

Meanwhile, a length corresponding to $\lambda/4$ of 500 MHz is typically 150 mm, but a first resonant length is reduced by the coupling effect of the first radiation element 200 and the second radiation element 300. Thus, in the present invention, a resonant length corresponding to $\lambda/4$ of 500 MHz is reduced, so the antenna can be miniaturized.

The first radiation element 200 can resonate at a third resonant frequency band, such as L-BAND, of the harmonic components of the first resonant frequency. Thus, the first radiation element 200 can obtain the broadband characteristic by employing overlapping of frequency bands and can implement multiple bands using the harmonic components as the third resonant frequency. Consequently, the antenna can be miniaturized. Here, the frequency can be tuned by controlling the length of the ground stub.

The second radiation element 300 can resonate at a second resonant frequency, for example, the BANDIII (T-DMB) band. An electrical signal supplied from the power feed unit 600 is applied to the second radiation element 300 through the first inductor 800 formed at a lower side of the first radiation element 200. Here, the first inductor 800 is a serial coil type inductor and functions as an extension coil, so the size of the antenna can be reduced.

At this time, the first inductor 800 can operate as a low-pass filter having the cutoff characteristic about 300 MHz or more. This characteristic can be employed to prevent the second radiation element 300, radiating light at the BANDIII band, from affecting the characteristics of other bands.

The second inductor 900 also has the cutoff characteristic with respect to other resonant frequency bands and very low impedance at an operating frequency. Thus, the second inductor 900 is connected to the second and third radiation elements 300, 400 and can operate as one radiation element. Unlike the embodiments shown FIGS. 1 and 2, a plurality of inductor can be intervened in series between three or more radiation elements.

Meanwhile, the length of each of the radiation elements divided by the second inductor 900 can become $\frac{1}{5}\lambda$ or less of other resonant frequencies. This reduces the length of the second and third radiation elements 300,400, which resonate at the BANDIII band, to $\frac{1}{5}\lambda$ or less of other resonant frequencies, through the second inductor 900. Accordingly, the second and third radiation elements 300, 400 are made to operate as parasitic elements of the radiation elements having other resonant frequency bands. Consequently, performance such as expanded bandwidth can be improved.

The terminal circuit board 100 can include a ground material (not shown). The ground material can serve as a ground with respect to the plurality of radiation elements 200, 300, and 400, so the plurality of radiation elements 200, 300, and 400 can operate as a monopole antenna. There is no limit to the form of the ground material. The ground material can be modified in various forms such as a sheet type ground material.

The power feed unit 600 is a transmission line of signals, which are transmitted and received by the plurality of radiation elements 200, 300, and 400. The power feed unit 600 can be constructed of a central conductor that transmits signals, such as a coaxial cable, and a cable constructed of an external conductor serving as a ground. The central conductor of the cable is connected to the plurality of radiation elements 200, 300, and 400. The external conductor serving as the ground of the cable is connected to the ground material.

Meanwhile, in the case where the antenna including the plurality of radiation elements 200, 300, and 400 is connected to a portable terminal, the resonant frequency, etc. can be changed due to several causes such as impedance matching or coupling with the portable terminal. In order to tune this change of the resonant frequency and reduce reflection loss, a tuning process is performed.

This can be performed by controlling the form, length, an adjacent length, etc. of each radiation element, the size of the ground stub 500, which is formed on one side of the radiation element and coupled thereto, an adjacent distance with the radiation element, and so on. This can also be performed by controlling the ground stub matching unit 700.

FIG. 3 is a diagram showing a multiple band antenna according to another embodiment of the present invention.

Referring to FIG. 3, the multiple band antenna of the present invention can be applied to an intenna as well as the monopole antenna. In more detail, the intenna includes a power feed unit 600 having one end coupled to a predetermined portion of a terminal circuit board 100 and the other end coupled to a first radiation element 200, in the same manner as the monopole antenna. One end of a first inductor 800 can be coupled to a predetermined portion of the first radiation element 200 and a pre-determined portion of the second radiation element 300 can be coupled to the other end of the first inductor 800. The second inductor, the third radiation element, the ground stub, and the ground stub matching unit may be omitted depending on the specification of the antenna.

The multiple band antenna of the present invention has been described above. However, it is to be understood that the technical constructions of the present invention can be implemented in various ways by those having ordinary skill in the art without departing from the scope and spirit of the invention.

Further, it is evident that a variety of portable terminals, transmission and reception devices for wireless communication, etc. employing the multiple band antenna of the present invention can be included within the scope of the invention.

Therefore, it is to be understood that the invention is not limited to the disclosed embodiments, but is intended to cover various modifications and equivalent arrangements included within the spirit and scope of the appended claims.

What is claimed is:

1. A multiple band antenna comprising:

a first radiation element adapted to resonate at a first resonant frequency band by employing a resonant length, which is reduced by a coupling effect with a neighboring radiation element;

a power feed unit coupled to one lower side of the first radiation element so as to supply power to the first radiation element;

a first inductor coupled in series to the other lower side of the first radiation element;

a second radiation element adapted to face the first radiator to thereby obtain the coupling effect, wherein the second radiation element has a predetermined lower portion coupled to the first inductor;

a second inductor having one end coupled in series to a predetermined upper portion of the second radiation element; and a third radiation element coupled to the other end of the second inductor, wherein the third radiation element operates as one radiation element together with the second radiation element and resonates at a second frequency band.

2. The multiple band antenna as defined in claim 1, further comprising:

a ground stub having a band expansion effect, wherein a length of the ground stub can be turned in order to control a detailed frequency; and a ground stub matching unit matched to a resonant frequency through the control of the ground stub.

3. The antenna as defined in claim 1, wherein the first inductor or the second inductor serve as an extension coil, thus reducing the size of the antenna.

4. The antenna as defined in claim 1, wherein the first inductor operates as a low-pass filter, thus preventing the second radiation element from affecting characteristics of other bands other than the second resonant frequency band.

5. The antenna as defined in claim 1, wherein the second inductor has a cutoff characteristic with respect to resonant frequency bands other than the second resonant frequency band and has very low impedance at the second resonant frequency band, so the second radiation element and a third radiation element are connected to each other and together operate as one radiation element.

6. The antenna as defined in claim 1, wherein the length of the second or third radiation element is $\frac{1}{5}\lambda$ or less of the first resonant frequency and operates as a parasitic element of the first radiation element.

7. The antenna as defined in claim 1, wherein the first radiation element resonates at a DVB-H band, and the second radiation element and a third radiation element resonate at a BANDIII band.

8. The antenna as defined in claim 1, wherein the first radiation element resonates at a third resonant frequency band, that is, a harmonic component of the first resonant frequency.

9. A wireless communication device comprising a multiple band antenna comprising:

a first radiation element adapted to resonate at a first resonant frequency band by employing a resonant length, which is reduced by a coupling effect with a neighboring radiation element;

a power feed unit coupled to one lower side of the first radiation element so as to supply power to the first radiation element;

a first inductor coupled in series to the other lower side of the first radiation element;

a second radiation element adapted to face the first radiator to thereby obtain the coupling effect, wherein the second radiation element has a predetermined lower portion coupled to the first inductor;

a second inductor having one end coupled in series to a predetermined upper portion of the second radiation element; and a third radiation element coupled to the other end of the second inductor, wherein the third radiation element operates as one radiation element together with the second radiation element and resonates at a second frequency band.

* * * * *